US005713404A

United States Patent [19]

Ladewig

[11] Patent Number: 5,713,404

[45] Date of Patent: Feb. 3, 1998

[54] FOLDING WORK CENTER

[75] Inventor: Christopher G. Ladewig, Littleton, N.C.

[73] Assignee: Flambeau Products Corporation, Middlefield, Ohio

[21] Appl. No.: 695,943

[22] Filed: Aug. 12, 1996

[51] Int. Cl.[6] ..... B25H 1/00; B25H 1/12

[52] U.S. Cl. ..... 144/285; 108/42; 144/286.1; 312/245

[58] Field of Search ..... 83/574; 108/38, 108/40, 42, 108, 152; 312/245; 269/289 R; 144/285, 286.1, 286.5, 287

[56] References Cited

U.S. PATENT DOCUMENTS

| | | | |
|---|---|---|---|
| 916,763 | 3/1909 | McKee | 144/286.1 |
| 1,284,512 | 11/1918 | Werner | 144/286.1 |
| 5,355,810 | 10/1994 | Camilleri | 108/42 |
| 5,381,738 | 1/1995 | Meyer | 108/42 |
| 5,528,993 | 6/1996 | Vincelli | 108/42 |

*Primary Examiner*—W. Donald Bray
*Attorney, Agent, or Firm*—Banner & Witcoff, Ltd.

[57] ABSTRACT

A workbench kit includes a support bracket panel which is hinged along one side on a wall. A work platform panel is also hinged to the wall by means of a storage rack with integrally molded attachment clamps. The work platform panel may be pivoted about its axis of attachment to the wall between a work position and a storage position, as may the support panel. When in the work position, the support panel is releasably attached to the work platform as a support bracket. When in the storage position, the panels fold over each other against the supporting wall.

7 Claims, 5 Drawing Sheets

26
36
36
20
1
32
38
76

20
76
38
34
34
32
30
38
34
76

FIG. 7
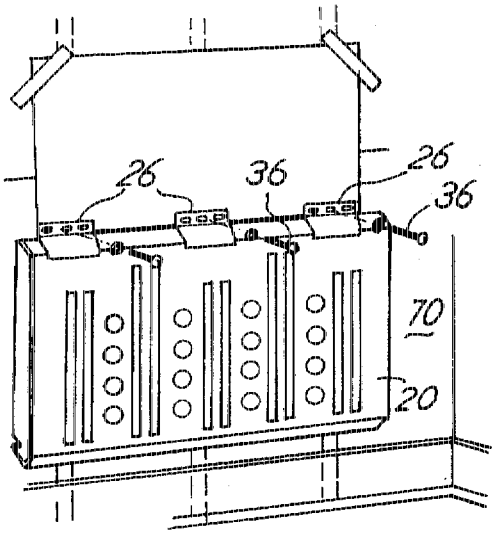
FIG. 8
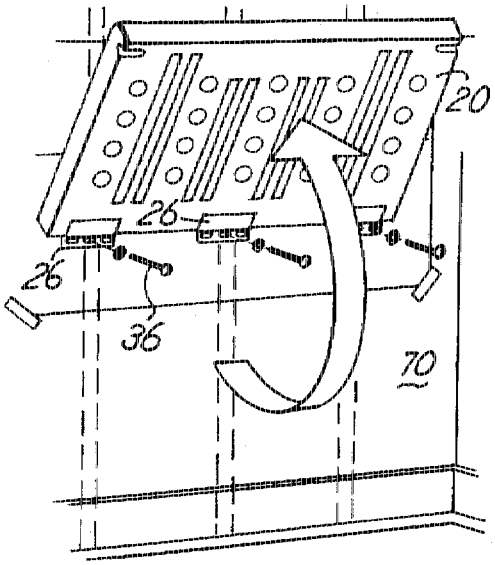
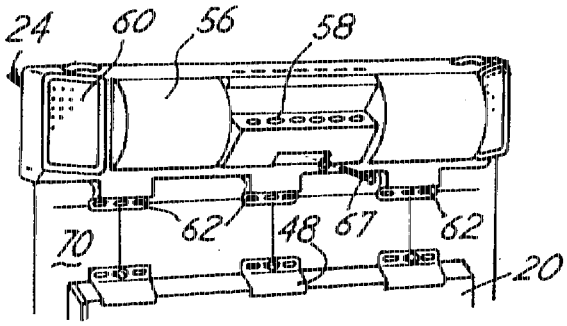
FIG. 9
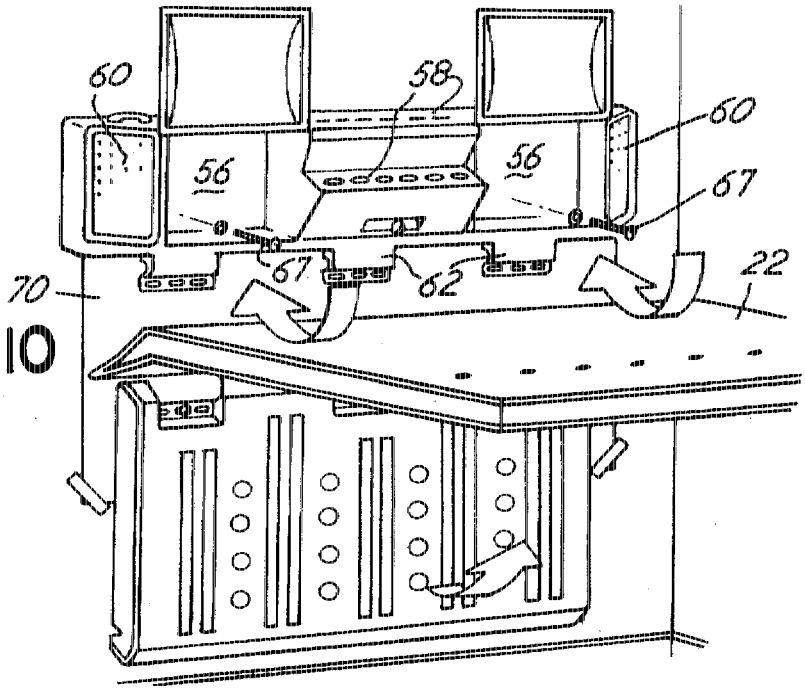
FIG. 10

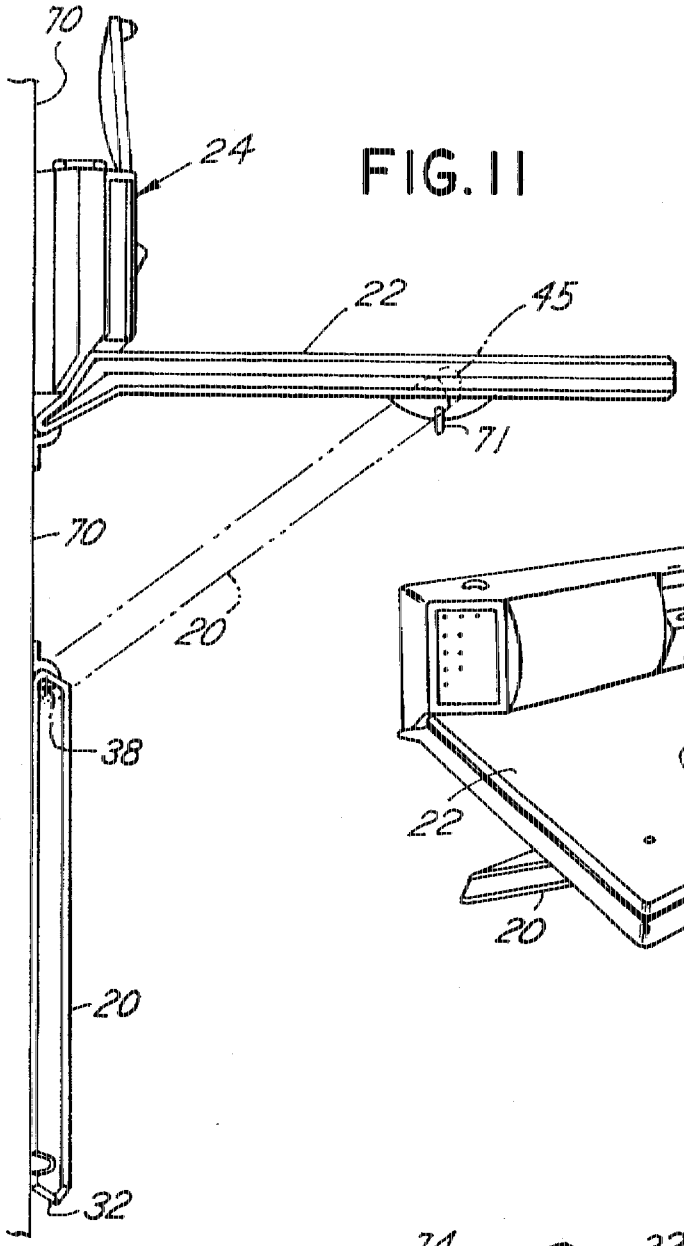
FIG. 11
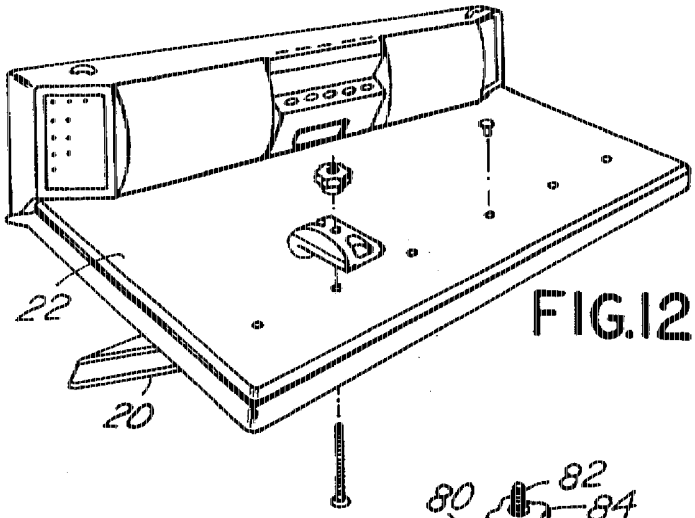
FIG. 12
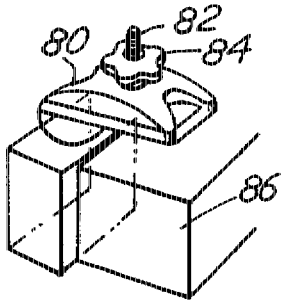
FIG. 14
FIG. 13
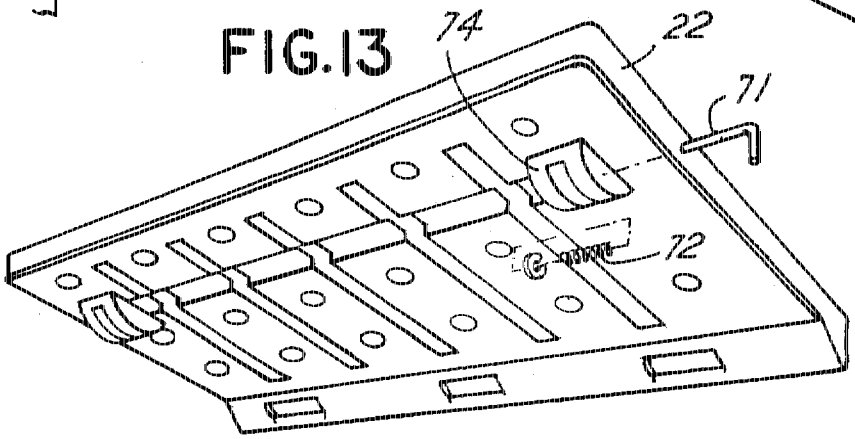

FOLDING WORK CENTER

BACKGROUND OF THE INVENTION

This invention relates to a foldable workbench construction of the type which is mounted on a wall or similar vertical surface.

Various types of workbenches are utilized by home craftsmen and others. A typical bench may be in the form of a table. It may be mounted on rollers, for example, or it may be attached rigidly to a wall. Other types of workbench constructions include tabletops, which are held by brackets on a wall.

Such workbench constructions all require a significant amount of room, particularly when not in use. Thus, there has developed a need for a workbench which may be disassembled or arranged so as to be space effective.

SUMMARY OF THE INVENTION

In a principal aspect, the present invention comprises a folding workbench which is supported by a vertical surface, such as a wall. The assembly comes in the form of a kit for which includes a support panel that is attached by a hinging mechanism to a vertical support surface such as a wall. A work surface panel is also attached to the support surface or wall above the support panel by means of a hinge assembly, which includes, in a preferred embodiment, a storage rack with integral hinge members incorporated therein. The work surface panel folds over the support panel when the workbench is in a first, or storage, position. The work surface panel may be pivoted to a second or horizontal position and engaged by the support panel, which is also pivoted, so as to form a bracket to support the work surface panel. The workbench includes various features, such as a mechanism for interlocking the underside of the work surface panel with the support panel, a series of work piece clamps or dogs which are interactive with openings in the work surface panel, and a tool storage rack, which includes various storage bins and holders for tools and the like.

Thus, it is an object of the invention to provide an improved work surface or platform for use in carpentry and for similar uses.

It is a further object of the invention to provide a workbench kit, which may be attached to a vertical surface, such as a wall, and which includes a support panel that is hinged to the wall and acts as a bracket when engaged with a work surface panel, that is also hinged to the wall by means of a storage rack.

Yet another object of the invention is to provide a simple and economical workbench kit, which may be easily assembled and attached in a work room on a vertical surface in that room.

Yet another object of the invention is to provide a workbench kit which may be folded into a storage position requiring a minimum amount of space when not in use.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 7 is a perspective view illustrating the manner by which the first support platform or support panel is attached to a vertical work or support surface;

FIG. 8 is a perspective view similar to FIG. 7 illustrating the manner by which clamp brackets are utilized to attach the support platform of FIG. 7 and FIG. 1 to a vertical support surface;

FIG. 9 is a perspective view illustrating the manner in which the clamp assembly or storage rack is attached to a vertical support surface;

FIG. 10 is a further illustration in the manner in which the storage rack as well as the work surface or work platform are attached to a vertical support surface;

FIG. 11 is a side elevation depicting the attached support panel, work platform and storage back panel or clamp assembly on a vertical support surface with the work platform in the horizontal position and the support panel shown in the storage position as well as in phantom in the support position;

FIG. 12 is a perspective view of the workbench kit fully assembled and in position to serve as a workbench in combination with a series of dogs or clamps which may be utilized in combination with the work platform or work surface panel;

FIG. 13 is a perspective view of the undersurface of the work platform; and

FIG. 14 is a perspective view illustrating the manner by which a clamp may be utilized to hold wood or some other item on the work platform surface.

DESCRIPTION OF THE PREFERRED EMBODIMENT

Figure 2:
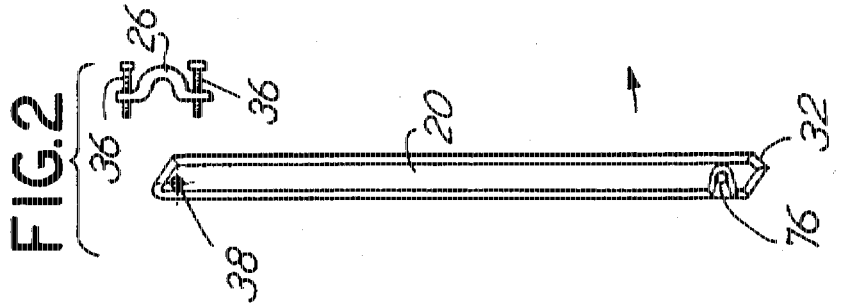
FIG. 2 is a side elevation of the platform or panel of FIG. 1 in combination with a clamp bracket utilized for attachment of the support panel to a wall or other vertical surface, for example.

Referring to the figures, the workbench kit of the present invention is comprised of three basic components. The first of these components is a support platform or support panel 20 depicted in FIGS. 1 and 2. The second basic element is a work platform or work surface panel 22 depicted in FIGS. 3 and 4. The third basic element of the kit is a storage rack panel which acts as a hinge clamp assembly for the work platform 22 and is illustrated as the panel 24 in FIGS. 5 and 6. In addition to these basic component parts, U-shaped clamps or brackets 26 as shown in FIG. 2 are utilized to attach the support platform 20 to a vertical support surface, such as a wall 76 or the studs of a wall 70. Thus, the following description will initially focus upon the component parts of the kit and then the assembly thereof to form the workbench.

Figure 1:
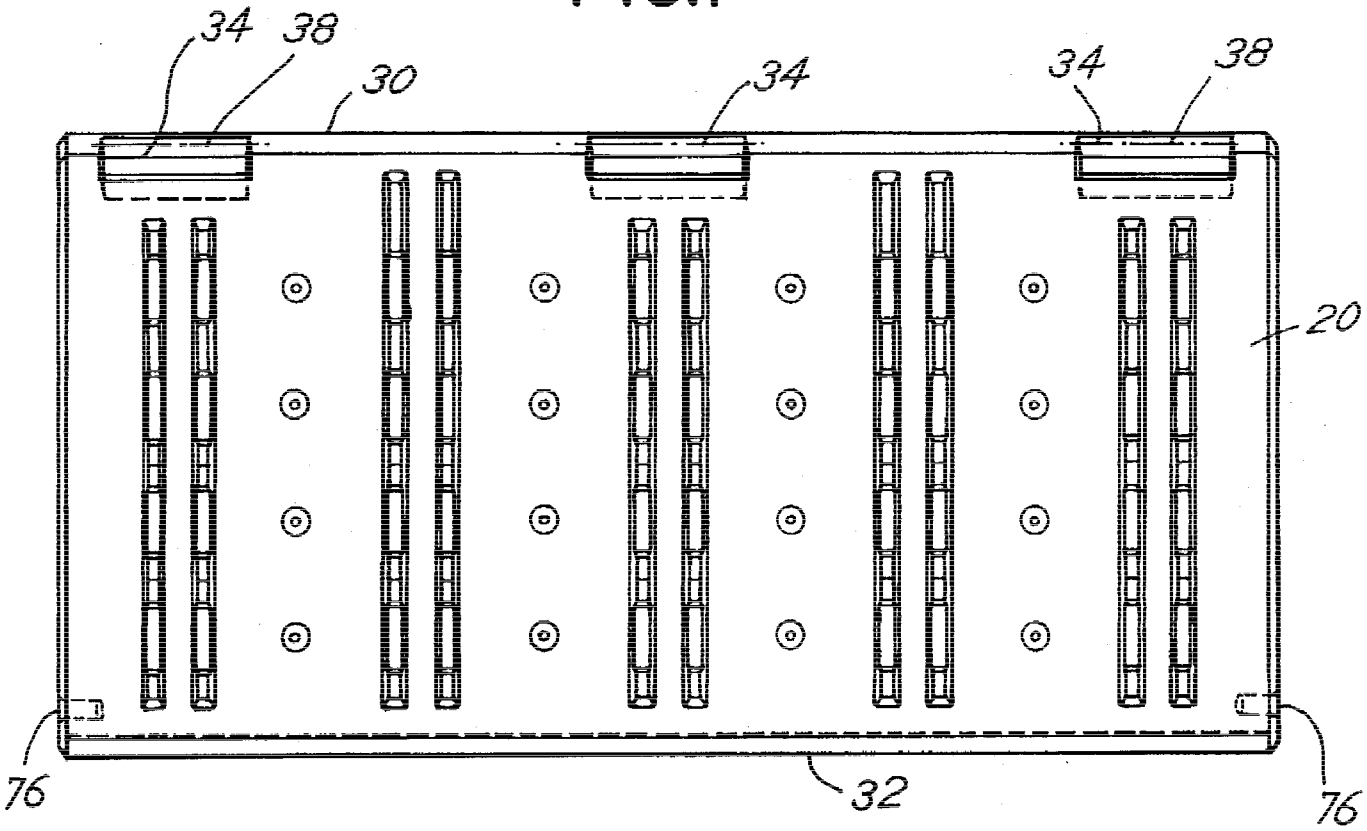
FIG. 1 is a front plan view of a support panel or first support platform of the workbench kit of the invention.

Referring to FIG. 1, the support platform or panel 20 is a generally rectangular molded plastic structural member having opposed, parallel sides 30 and 32. The first side 30 includes a series of integrally molded, coaxial, hinge pins 34. The opposite side 32 is configured so as to be engageable and retained within a slot in the work platform or panel 22 to be described below. The side or edge 32 thus has a shaped configuration, typically as depicted in FIG. 2.

The U-shaped clamps 26 coact with and hold the hinge pins 34 when the clamps 26 are attached by means of a fasteners, for example, fasteners 36 to a vertical surface, such as a wall 70. In this manner, the support platform 20 may be pivoted outwardly from a vertical support surface about a pivot axis 38 defined by the hinge pins 34.

Figure 3:
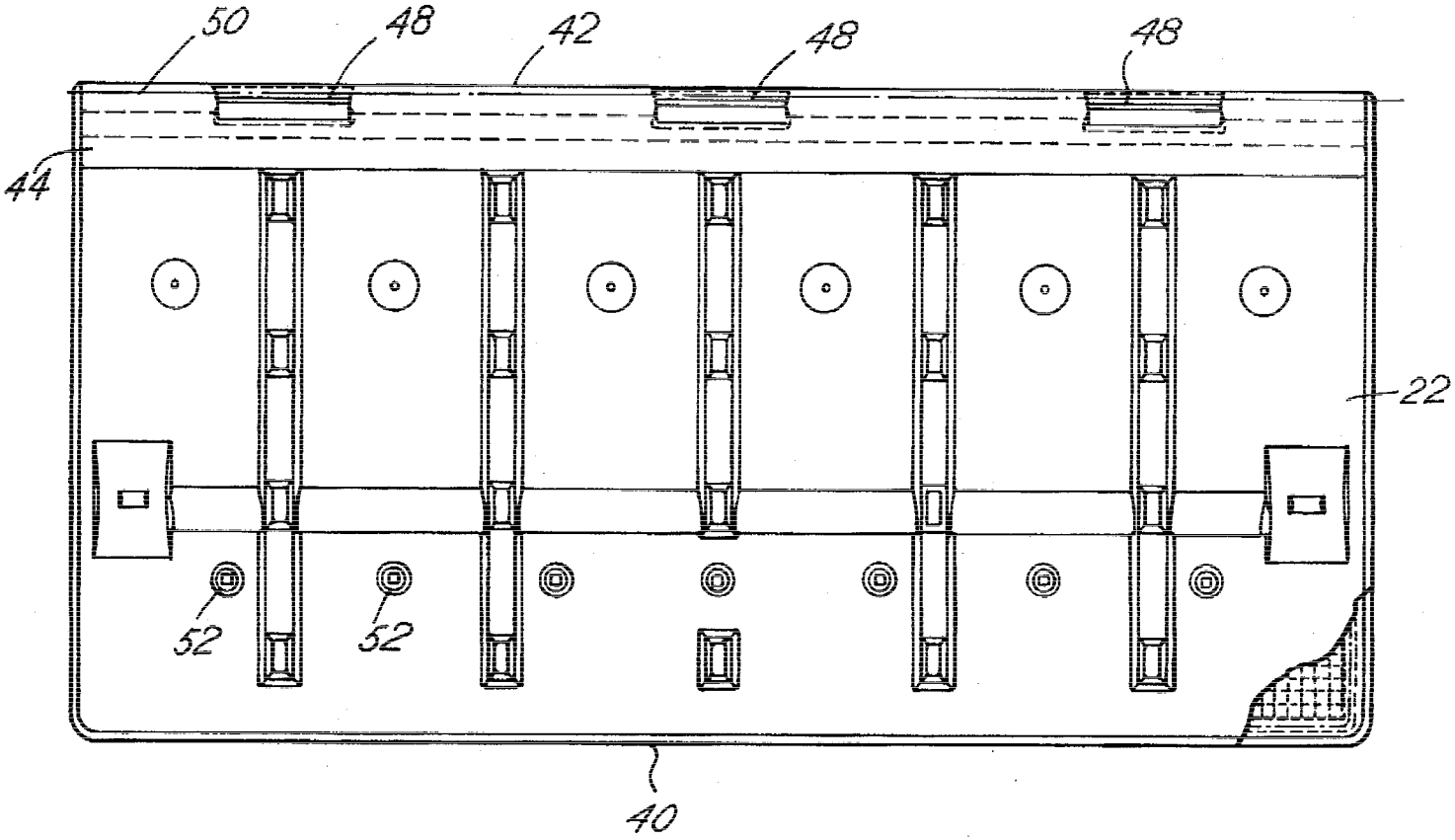
FIG. 3 is a top plan view of the work surface panel or work platform of the workbench kit of the invention.

FIG. 3 illustrates the work platform 22. The work platform 22 is also generally rectangular in shape and includes a front edge 40. The work platform 22 also includes a straight back edge 42 which is arranged on a wing 44 which arches or is arranged at an obtuse angle relative to the main planer section 46 of the platform 22. The edge 42 includes a series of integrally molded, coaxial, hinge pins 48 which are spaced from one another and which are coaxial along an axis 50 which defines a pivot axis for the work platform 22. A series of openings 52 in the panel 46 are defined for receipt of bolts or holders for holding a work piece on the work platform 22.

Figure 6:
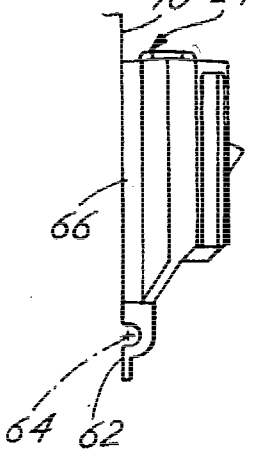
FIG. 6 is a side plan view or side elevation of the assembly of FIG. 5.
Figure 5:
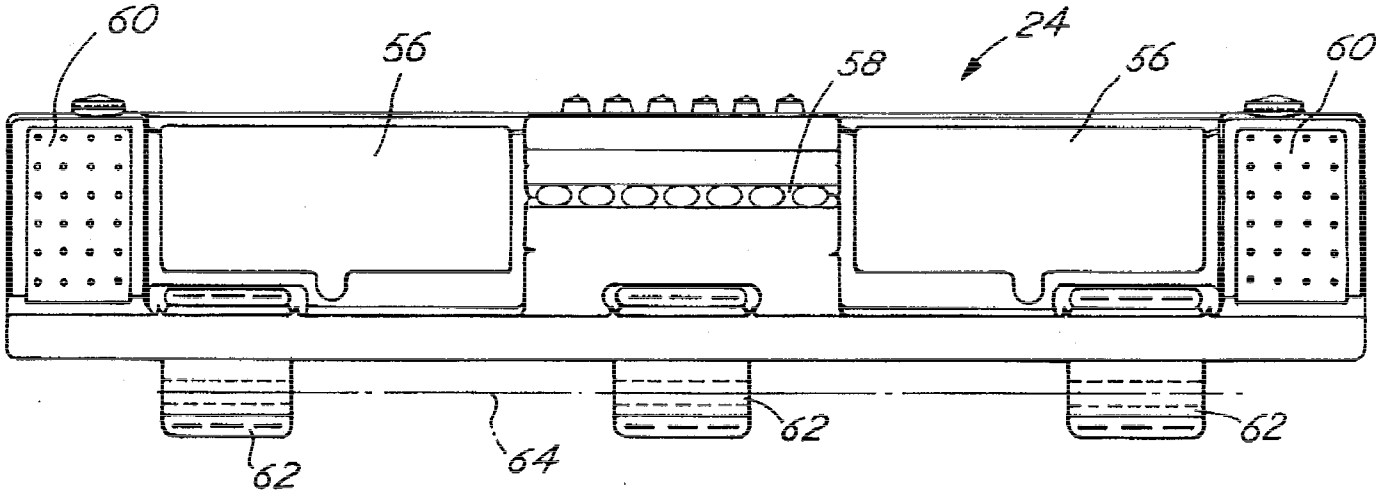
FIG. 5 is a front elevation of the storage rack panel or hinge clamp assembly for attaching the work platform to a vertical support surface.

The hinge pins 48 are held in position for pivotal movement by means of a clamp assembly and in the preferred embodiment by a storage rack panel 24 with a series of integrally molded U-shaped clamps 62. Thus, referring to FIG. 5, there is depicted the storage assembly 24 which includes, by way of example, storage bins 56, tool racks 58 and peg boards 60 all integrally formed and molded into the clamp assembly storage rack panel 24. Depending from the panel 24 are a series of integrally, molded U-shaped clamps 62 as depicted in FIGS. 5 and 6. Each clamp 62 defines a pivot axis 64 and is designed to be engaged with and fit over the hinge pins 48 of the work platform 22. Thus, the integral clamps 62 are spaced from one another by the same distance as the hinge pins 48. Any one or more hinge pins 48 may be utilized. An important feature, however, is that the clamps 62 will retain the pins 48 for pivotal movement. The storage rack panel 24 also includes a back surface or back panel 66 which is adapted to receive fasteners 67 for attachment of the panel 24 to a vertical support surface 70.

The remaining figures depict the manner in which the kit is assembled and utilized in the practice of the invention. As depicted in FIG. 7, the clamps 26 are attached by fasteners 36 to a vertical support surface or wall 70 thereby fitting over the hinge pins 34 and holding the support panel 20 in a pivotal position about axis 38. FIG. 8 illustrates the manner in which the fasteners 36 are attached to the underside or beneath the panel 20. The clamps 26 include fastener slots so that if the assembly is attached to a vertical wall 70 comprised of vertical studs, the fasteners 36 can be adjusted so as to engage with the studs and hold the support panel 20 in position permitting pivotal movement as depicted in FIGS. 7 and 8.

Figure 4:
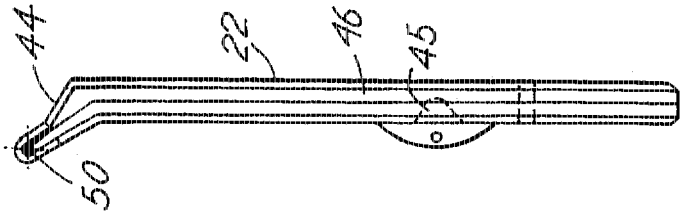
FIG. 4 is a side elevation of the work platform of FIG. 3.

FIG. 9 illustrates the manner by which the support or storage rack panel or hinge clamp assembly 24 is attached to the same vertical surface 70, which supports the support platform 20. The hinge members 62 engage with the hinge pins 48 to thereby hold the work platform 22 in a pivotal position for pivoting about pivot axis 50 above the support platform or support member 20. It should be noted that in aligning the various component parts, it is appropriate that the support platform 20 be centered laterally between the sides of the work platform 22 so that the leading edge 32 will appropriately fit into a groove 45 defined in the lower or bottom surface of the work platform 22 as depicted in FIG. 4. Also, the pivot axis 50 of the work platform 22 is positioned vertically above and spaced vertically above and parallel to the pivot axis 38 of the support platform 20. In this manner, as depicted in FIG. 11, when the support platform 20 is pivoted about the axis 38 so as to permit the leading edge 32 to engage in groove 45, the leading edge 32 will be appropriately centered in the groove 45.

In order to make sure that the assembly is rigidly held together, as depicted in FIG. 13, the bottom surface of the support or work platform 22 not only includes the groove 45, but at opposite ends of the groove 45 there is included an L-bolt 71 which is biased by a spring 72 through a support member 74 so as to be spring biased into openings 76 in the opposite ends of the leading edge 32 of the support platform 20. When one desires to detach the work platform 22 from the support platform 20, the L-bolts 71 are manually moved to disengage the support platform 20 from the work platform 22, thereby permitting the assembly to be folded into the storage position which is depicted, in part, in FIG. 11.

FIG. 14 illustrates the manner by which a clamp or dog 80 held by a bolt 82 cooperative with a knob 84 holds a work piece 86 on the top work surface of the work platform 22. The bolt, 82 thus fits through various openings, such as opening 52 in the work platform 22. In operation then, the work platform 22 may be pivoted about its axis 50 between a storage position against the vertical support surface and a work position, for example as illustrated in FIG. 12. When in the storage position, panel 22 fits over and covers panel 20 and the panels 20, 22 remain tightly overlapping one another.

Various alternative configurations of the work platform 22, the support panel 20 and the storage rack panel 24 may be utilized and developed in the practice of the invention. The invention, therefore, is to be limited only by the following claims and their equivalents.

What is claimed is:

1. A workbench kit comprising, in combination:

a first support platform, said platform including a hinge attachment side and a spaced, work platform support side parallel thereto, said hinge attachment side including at least one integral hinge pin formed in the hinge attachment side;

a hinge clamp attachable to a vertical support surface, said clamp including a pin reception slot for pivotal receipt and retention of the support platform hinge pin when said clamp is attached to the support surface to align the hinge pin as a horizontal pivot axis for the support platform;

a work platform including at least one integral hinge pin along one side of said platform, said platform including a planer top work surface and a bottom surface with a longitudinal support platform engagement member parallel to the work platform hinge pin and capable of interaction with the support side of the support platform to maintain the work platform in a horizontal plane;

at least one hinge clamp assembly for attaching the work platform hinge pin to a vertical support surface pivotal about an axis parallel to the axis of the support surface hinge pin, said hinge clamp assembly arranged to support the work platform hinge pin vertically spaced above the support platform, whereby the platforms, when so mounted, are pivotal against one another and a support wall in a first non-support position, and in an alternative horizontal work platform position with the support platform support side engaging the engagement member of the work platform in a second support position with the support platform defining a bracket to hold the work platform in place.

2. The kit of claim 1, including means for latching the support platform to the work platform when the work platform is in the second support position.

3. The kit of claim 1 wherein the work platform includes a series of through passages and further includes a clamp mechanism cooperative with a passage to hold a work piece.

4. The kit of claim 1 wherein the hinge clamp assembly for the work platform includes a hinge clamp with a hinge pin slot for mounting a hinge pin and further includes a storage bin incorporated with the leverage clamp assembly.

5. The kit of claim 1 wherein the support platform includes a plurality of coaxial hinge pins.

6. The kit of claim 1 wherein the work platform includes a plurality of coaxial hinge pins.

7. The kit of claim 4 wherein the storage bin includes a planar back, said back including means for attachment to a vertical support surface.

* * * * *